US007571897B2

(12) United States Patent
Heinz

(10) Patent No.: US 7,571,897 B2
(45) Date of Patent: Aug. 11, 2009

(54) METAL FENCE POST AND FENCE SYSTEM

(76) Inventor: David D. Heinz, 4709 N. El Capitan, #104, Fresno, CA (US) 93722

( * ) Notice: Subject to any disclaimer, the term of this patent is extended or adjusted under 35 U.S.C. 154(b) by 0 days.

(21) Appl. No.: 12/005,461

(22) Filed: Dec. 27, 2007

(65) Prior Publication Data

US 2009/0166598 A1 Jul. 2, 2009

(51) Int. Cl.
*E04H 17/20* (2006.01)

(52) U.S. Cl. ..... 256/65.03; 256/DIG. 5

(58) Field of Classification Search ..... 256/21, 256/22, 47, 48, 54, 59, 65.01–65.03, 65.08, 256/69, 72, DIG. 5; 403/13; 248/220.21, 248/221.11, 222.14, 223.41, 224.61
See application file for complete search history.

(56) References Cited

U.S. PATENT DOCUMENTS

| | | | | | |
|---|---|---|---|---|---|
| 131,038 | A | | 9/1872 | Sprout | |
| 492,876 | A | * | 3/1893 | Band et al. | 256/68 |
| 1,517,119 | A | | 11/1924 | Luhring | |
| 2,150,291 | A | * | 3/1939 | Paque | 52/153 |
| 2,227,553 | A | | 1/1941 | Paque | |
| 2,520,313 | A | * | 8/1950 | Harris | 256/22 |
| 2,795,399 | A | * | 6/1957 | Anderson | 256/12.5 |
| 2,919,112 | A | * | 12/1959 | Cofield | 256/22 |
| 3,284,971 | A | | 11/1966 | Attwood | |
| 3,415,491 | A | * | 12/1968 | Wilcox | 256/39 |
| 4,386,762 | A | | 6/1983 | Collins | |
| 4,471,947 | A | * | 9/1984 | Osborne | 256/24 |
| 4,503,636 | A | * | 3/1985 | Stuckey | 47/44 |
| 4,542,885 | A | | 9/1985 | Rossiter | |
| 4,616,950 | A | | 10/1986 | Morris | |
| 4,910,933 | A | * | 3/1990 | Schwarzfeller et al. | 256/47 |
| 4,995,590 | A | | 2/1991 | Close | |
| 5,277,408 | A | * | 1/1994 | Parker | 256/65.02 |
| 5,314,167 | A | * | 5/1994 | Holloman | 256/69 |
| 5,496,016 | A | * | 3/1996 | Parisien | 256/68 |
| 5,676,351 | A | | 10/1997 | Speece et al. | |
| 5,730,426 | A | * | 3/1998 | Tu | 256/54 |
| 6,173,945 | B1 | | 1/2001 | Lindsey et al. | |
| 6,530,561 | B2 | * | 3/2003 | Larsen et al. | 256/24 |

* cited by examiner

*Primary Examiner*—Daniel P Stodola
*Assistant Examiner*—Joshua T Kennedy
(74) *Attorney, Agent, or Firm*—Richard A. Ryan

(57) ABSTRACT

A metal fence post for use with a wood fence system and a method of constructing a wood fence. The fence post comprises an elongated post member and a bracket attached thereto to support rails and pickets. The post member is of the type commonly available as vineyard posts and signposts, having a back wall and a pair of outwardly sloping sidewalls with short wing flanges attached thereto. The back wall and sidewalls form a channel. The bracket has a center section and a pair of outwardly sloping sidewalls that each have outwardly extended flanges. The flanges are generally in the same plane and in spaced apart relation to the center section. The center section of the bracket is received in the channel, placing the flanges in abutting relation with the wing flanges. A portion of the fence post is exposed so as to enhance the aesthetics of the fence.

17 Claims, 10 Drawing Sheets

METAL FENCE POST AND FENCE SYSTEM

CROSS-REFERENCE TO RELATED APPLICATIONS

None.

BACKGROUND OF THE INVENTION

A. Field of the Invention

The field of the present invention relates generally to wood fence systems. More particularly, the present invention relates to wood fence systems that utilize metal fence posts to support a plurality of wooden fence rails and pickets. Even more particularly, the present invention relates to a metal fence post that is formed from a metal fence post bracket which is mounted to a commonly available metal post to support a wood fence system.

B. Background

As is well known, fence systems are commonly utilized to separate one person's property from another person's property and/or to separate a single property into separate sections. Despite the availability of many different types of materials, including metals, plastics and a variety of different composites, wood fence systems are often preferred by many property owners, especially for homes and other residential properties. The reasons for the preference of wood fence systems include aesthetics, costs, blending with other neighborhood fences and materials utilized in nearby structures and due to the contractor's familiarity with wood materials.

Wood fences are typically, but not exclusively, configured in a post, rail and picket formation whereby a series of spaced apart posts are inserted into the ground in a substantially vertical configuration, one or more rails are mounted to the posts in a generally perpendicular manner (often one near the top of the post, near the middle of the post and near the bottom of the post) such that they are generally horizontal relative to the ground and a plurality of pickets are mounted perpendicularly in a side-by-side configuration to the rails in a generally vertical orientation which is substantially parallel to the posts. In the typical prior art wood fence system, the material used for the posts, rails and pickets has been wood, with wood four inch by four inch square posts being commonly utilized. Typically, the bottom portion of the wood fence post is inserted into a hole in the ground, which is filled with dirt, cement, concrete or other materials and then compacted around the fence post to provide additional support to the post and, therefore, the entire fence system. In many areas, the use of concrete or like material is mandated by city or county codes so as to reduce the likelihood the fence will fall over due to high winds. Even where not mandated, many fence owners and fencing contractors prefer to mount the posts in concrete to prevent strong winds, unexpected contact or other events causing the fence to be knocked down.

Often, wood fences are installed to replace a previous wooden fence. A common reason for replacing a fence is because it no longer stands in the preferred upright position due to the posts being unable to adequately support the weight of the rails and pickets (i.e., after being blown over). Often this results from deterioration of the wooden posts, particularly at or near the interface with the ground or concrete in which the post is buried. Generally, this deterioration takes place over time, weakening the fence system as it gets older. Even though the posts are not able to support the fence, the remaining components may still be in good condition. Even if this is the case, the fence owner typically replaces the entire fence system. Although some of the fence post deterioration can be avoided or substantially slowed by the use of proper preventative materials and techniques, such as specially formulated coatings, most fence owners do not apply these materials or do not apply them on a frequent enough basis. As a result, there is a need for a new fence post that can be utilized with wooden fence systems (i.e., the rails and pickets are still wood). Preferably, the new materials for fence posts should not detract from the beauty of the wooden fence system and, in fact, enhance the aesthetic appearance of the fence system.

Several manufactures and material suppliers have developed fence posts that substantially eliminate the deterioration problems with wooden fence posts by utilizing posts made out of non-wood materials, such as galvanized steel and the like (i.e., those which are strong, non-corrosive, etc.). These metal posts are inserted into a hole in the ground that is filled with concrete or other material and then the wood rails are mounted to the metal posts and the wood pickets are mounted to the rails, creating a fence system much like the typical all wood fence system. Often the metal posts are no more than square or round shaped tubular members, which tend to visually stand out and detract from the overall wood fence system. To avoid detracting from the beauty of a wood fence system, some manufactures utilize a metal fence post which is substantially hidden by the wood fence system components. As an example, the PostMaster™ fence post by Master-Halco comprises a generally U-shaped member having a pair of opposing, outwardly extending side members at the open end of the "U." (this fence post and system is the subject of one or more patents, including U.S. Pat. Nos. 6,173,945 by Lindsey, et al. and 6,530,561 by Larsen, et al.). The wood rail sections, such as 2×4s, are mounted to the post on opposite sides of the "U" against the side members. A series of holes in the side members are utilized for inserting nails or screws into the rails to connect it to the post. A separate piece of wood material is used to cover the otherwise exposed closed end of the "U". Although the Master-Halco U-shaped metal fence post provides some of the benefits over wood fence posts for wood fence systems, it does have several known drawbacks. For instance, the metal fence posts are typically made from bright galvanized steel, which generally does not enhance the color or texture of the wood fence members and, in fact, severely hurts the overall aesthetics of the fence. To improve the aesthetics, the U-shaped post is covered with wooden fence boards so it will not be seen. Covering the post in this manner generally makes these fence posts more difficult to use and costly to install. In addition to increasing the overall cost of the fence, these fence posts generally limit the configurations available for the fence when trying to hide the posts.

A metal post that has not heretofore been widely utilized as a fence post in wood fence systems is commonly known as a vineyard posts or signpost post. Although not utilized for wood fence systems, these posts have been utilized for many years in vineyards and to hold up signs, such as road signs and the like. In cross-section, the post has a pair of sloping sidewalls that are joined at their back edge by a substantially horizontal center wall and a pair of outwardly extending, but relatively short, wing flanges that extend generally horizontally from the front edge of each of the sidewalls in a configuration that is generally parallel to the center wall, such that the post is generally U-shaped with the sidewalls sloping outward from the center wall to the wing flanges. Although these posts are commonly manufactured and generally easily and economically obtained, the somewhat small length of the wing flanges (in part because the holes would not be attractive, the holes could not be easily hidden and the user would be limited in the type of attachment device utilized to secure the rail to the metal post) and other considerations have limited their consideration as a metal fence post. Due to the availability and common use of these posts, utilization of these posts as a fence post would generally provide for a lower cost and longer lasting fence system.

What is needed is an improved metal fence post for wood fence systems that provides for a lower overall cost and more aesthetically pleasing, longer lasting fence, without the need to hide or conceal the metal fence post. Preferably, the metal fence post comprises the commonly available vineyard post/signpost in a manner that is sufficient to support the wooden rails and pickets of a wood fence system. The preferred metal fence post and fence system will be easy to use and install to provide an overall more economical wood fence system. The metal post must be of sufficient strength to effectively support a typical wood fence system in an upright, vertical configuration. The preferred fence post should be shaped and configured to be easily inserted in the ground in an upright, vertical manner and adaptable for mounting one or more wooden rails thereto to support a plurality of pickets attached to the rails. To be effective, the metal fence post must be configured to adequately support the typical wooden fence system without requiring an undesirable number of posts.

SUMMARY OF THE INVENTION

The metal fence post and fence system using such post of the present invention solves the problems and provides the benefits identified above. That is to say, the present invention discloses a fence post which comprises the commonly available metal vineyard post/signpost in a manner that allows the fence post to support a wood fence system, such as those having one or more wood rails attached to the metal post and a plurality of wood pickets attached to the rails, in an upright, vertical configuration. The metal fence post of the present invention is relatively easy to use and inexpensive to manufacture, resulting in a fence post that is quicker and easier to install than presently available fence posts and which provides a more overall cost effective fence. The metal fence post of the present invention is aesthetically pleasing such that it can be exposed in the fence system, thereby eliminating the need to incur the additional time and expense of covering the metal post with one or more fence boards in order to hide or conceal the metal fence post. In a preferred embodiment, the metal fence post of the present invention comprises a specially configured bracket that attaches to the common vineyard post/signpost, with the fence system comprising one or more rails attached to the bracket and a plurality of pickets attached to the rail(s).

In one general aspect of the present invention, the metal fence post comprises an elongated post member and a bracket attached to the post member to support the rails and the pickets that make up a fence system. The post member has a first end that is configured to be inserted into the ground and a second end that receives the bracket or brackets. The post member has a first sidewall, a second sidewall that is spaced apart from the first sidewall, a back wall that interconnects the first sidewall and the second sidewall, a first wing flange that extends outwardly from the first sidewall and a second wing flange that extends outwardly from the second sidewall. The first and second wing flanges are substantially in the same plane and are in spaced apart relation to the back wall. The first sidewall, second sidewall and back wall define a channel.

The bracket used with the fence post of the present invention has a center section, a first sidewall attached to the center section, a second sidewall attached to the center section, a first flange that extends outwardly from the first sidewall and a second flange that extends outwardly from the second sidewall. The first and second flanges are substantially in the same plane and are in spaced apart relation to the center section. When the bracket is attached to the post member, the center section is received in the channel of the post member with the first flange of the bracket in substantially abutting relation with the first wing flange of the post member and the second flange of the bracket in substantially abutting relation with the second wing flange of the post member. In the preferred embodiment, the back wall of the elongated post member has one or more mounting apertures and the center section of the bracket has at least one bracket mounting aperture, with each of the apertures configured to receive a connector, such as a bolt and nut combination, therein to securely mount the bracket on the post member. Preferably, the height of the bracket is less than the height of the rail so that the rail will cover up the back side of the bracket when installed on the fence post. In the preferred embodiment, the first and second sidewalls of the post member angle generally outwardly from the back wall and the first and second sidewall of the bracket slope outwardly in substantially corresponding relation to the sidewalls of the post member to facilitate reception of the center section into the channel. In an alternative embodiment, each flange of the bracket has an outwardly extending support plate that is configured to allow the installer to rest one end of the rail thereon, thereby eliminating the need to have two people (i.e., one at each end) to attach the rail to the bracket. The flanges of the bracket also have one or more rail mounting apertures to further facilitate attachment of the rail or rails to the bracket.

The present invention also includes a fence system that utilizes the fence post described above with a rail attached to a back wall of the bracket and a plurality of pickets attached to the rail in generally side-by-side relation along a front side of the bracket. The present invention also includes a method of constructing a fence that comprises the steps of inserting a first or lower end of the elongated post member described above into the ground, attaching the bracket described above to the second end of the post member, attaching one or more rails to a back side of the bracket in a substantially horizontal configuration and then attaching a plurality of pickets to each of the rails in generally side-by-side relation along a front side of the bracket. For the fence system and method of constructing a fence, one side of the post will be completely exposed and at least a portion of the second side of the fence post is configured to be exposed (i.e., between lengths of pickets) to enhance the aesthetics of the fence. Because the fence post is not hidden, the time and overall cost of constructing the fence is reduced.

Accordingly, the primary objective of the present invention is to provide a metal fence post and fence system that provides the advantages discussed above and overcomes the disadvantages and limitations associated with presently available metal fence posts and wood fence systems that utilize such posts.

It is also an important object of the present invention to provide a metal fence post that is configured to be inserted into the ground or other surface and support one or more horizontally disposed wood rails to which is attached a plurality of pickets so as to define a wood fence system.

It is also an important object of the present invention to provide a metal fence post that beneficially utilizes the standard vineyard post/signpost or like posts by attaching thereto a bracket to which is attached one or more wood rails and a plurality of pickets.

It is also an important object of the present invention to provide a metal fence post comprising a metal bracket that is received across the open channel portion of a common metal post in a manner that allows the user to securely attach the bracket to the post with one or more bolts or other connectors and then connect one or more wood rails to the bracket.

It is also an important object of the present invention to provide a metal fence post that can be utilized in a wood fence system as a decorative component thereof in an aesthetically pleasing manner without the need to hide or conceal the fence post.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the figures which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. As known in the art, the enclosed figures and drawings are merely illustrative of a preferred embodiment and represent one of several different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description of the invention provided herein are primarily directed towards being utilized with wood rails and pickets, those skilled in the art will readily understand that this is merely for purposes of simplifying the present disclosure and that the present invention is not so limited, as the present invention is equally applicable for use with rails and pickets made out of different materials.

Figure 1:
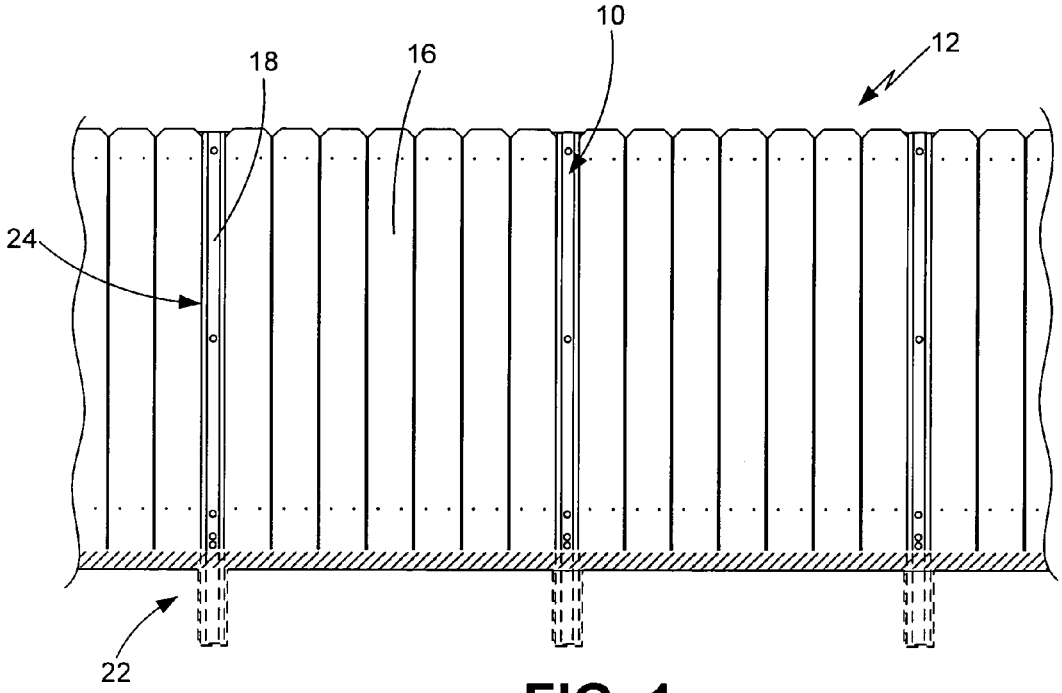
FIG. 1 is a front view of a fence system configured in accordance with a preferred embodiment of the present invention showing the use of an exposed metal fence post and wood pickets.
Figure 2:
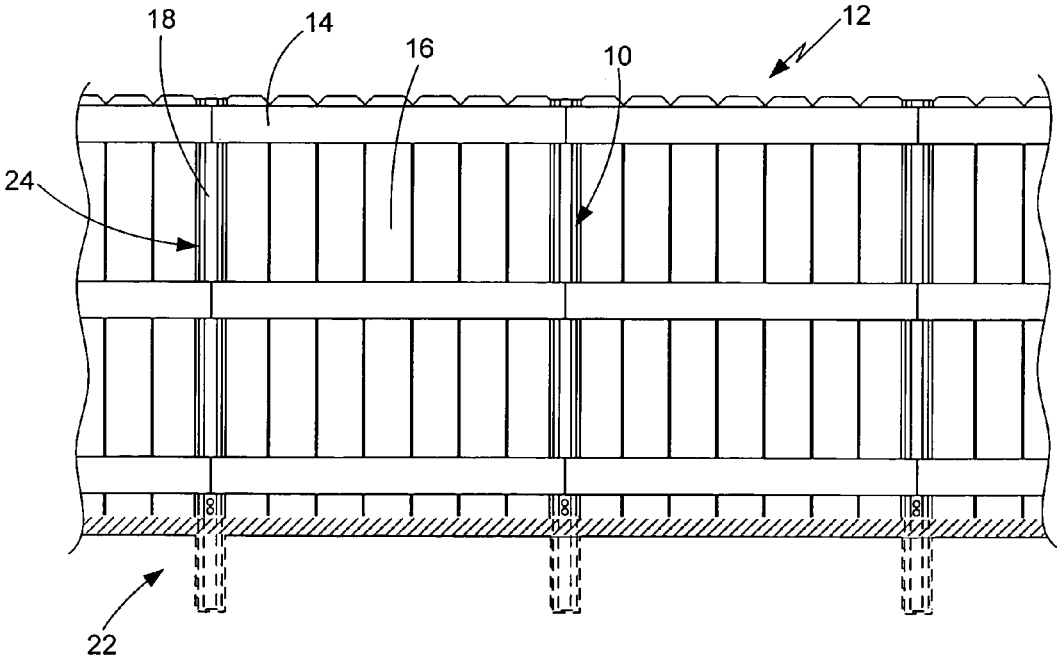
FIG. 2 is a back view of the fence system of FIG. 1 showing the metal fence post, wood rails and wood pickets.

A metal fence post that is manufactured out of the components and configured pursuant to a preferred embodiment of the present invention is shown generally as 10 in FIGS. 1 through 6. Metal fence post 10 is configured to be utilized with a fence system, shown generally as 12, so as to support the fence system 12 in a generally upright, vertical manner. The fence system 12 shown in the figures comprises wooden rails 14 and pickets 16. As explained in more detail below, rails 14 are attached to fence post 10 in a generally horizontally disposed position, relative to the ground surface, and pickets 16 are attached to rails 14 in a generally vertical arrangement (i.e., generally parallel to fence post 10). As best shown in FIGS. 2 through 6, fence post 10 of the present invention comprises an elongated post member 18 and one or more brackets 20 that are attached to the post member 18 to support the rails 14 by interconnecting the rails 14 with the elongated post member 18. As best shown in FIGS. 1 and 2, the first or lower end 22 of post member 18 is inserted into the ground to secure the fence system 12, supported by the second or upper end 24 of post member 18, in a generally upright position. Typically, the first end 22 of post member 22 is placed into a pre-dug hole and then supporting material, such as concrete, dirt, cement or other materials, is placed around the first end 22. Though different configurations can be utilized, often one rail 14 and bracket 20 combination is placed relatively near the top of the second end 24 of post member 18, one rail 14 and bracket 20 combination is placed relatively near the middle of the post member 18 and one rail 14 and bracket 20 combination is placed relatively near the bottom of second end 24 of post member 18, as best shown in FIG. 2. As will be well understood by those skilled in the art, the terms upper, lower, horizontal, vertical and upright are relative terms that describe the typical positioning of the fence system 12 and its components relative to the support surface on which the fence system is placed. Depending on the circumstances, the fence system 12 can be positioned in various other arrangements, including sideways and upside down.

Figure 3:
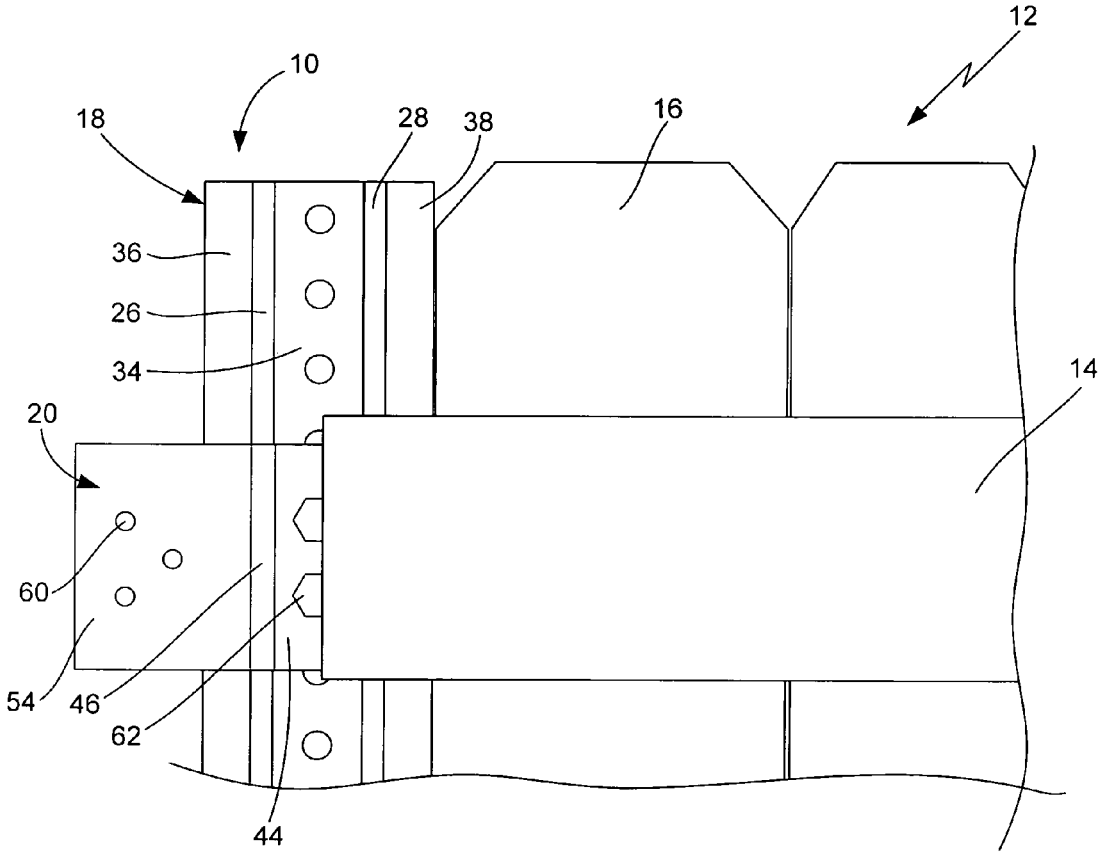
FIG. 3 is an isolated, partial view of the back side of the fence system of FIG. 2 showing use of the vineyard post/signpost post and bracket to support the wood rail and pickets.
Figure 4:
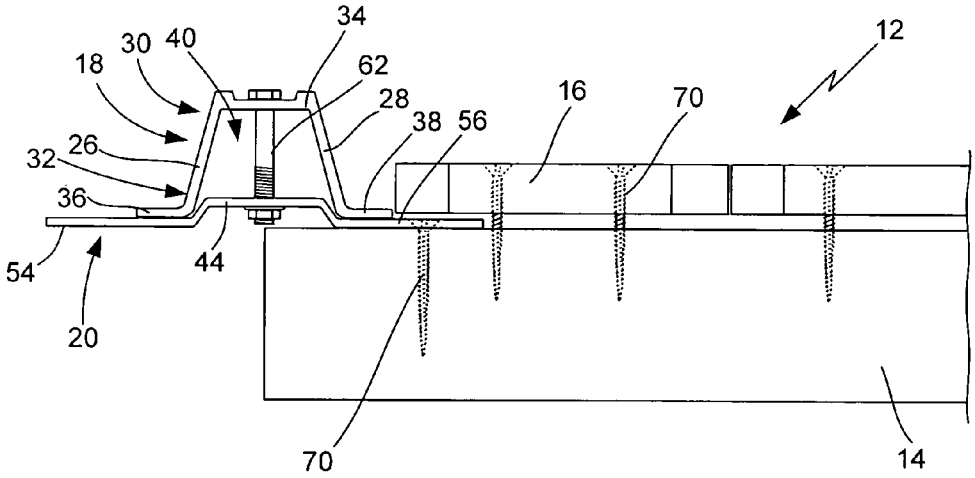
FIG. 4 is a top view of the fence system of FIG. 3.
Figure 5:
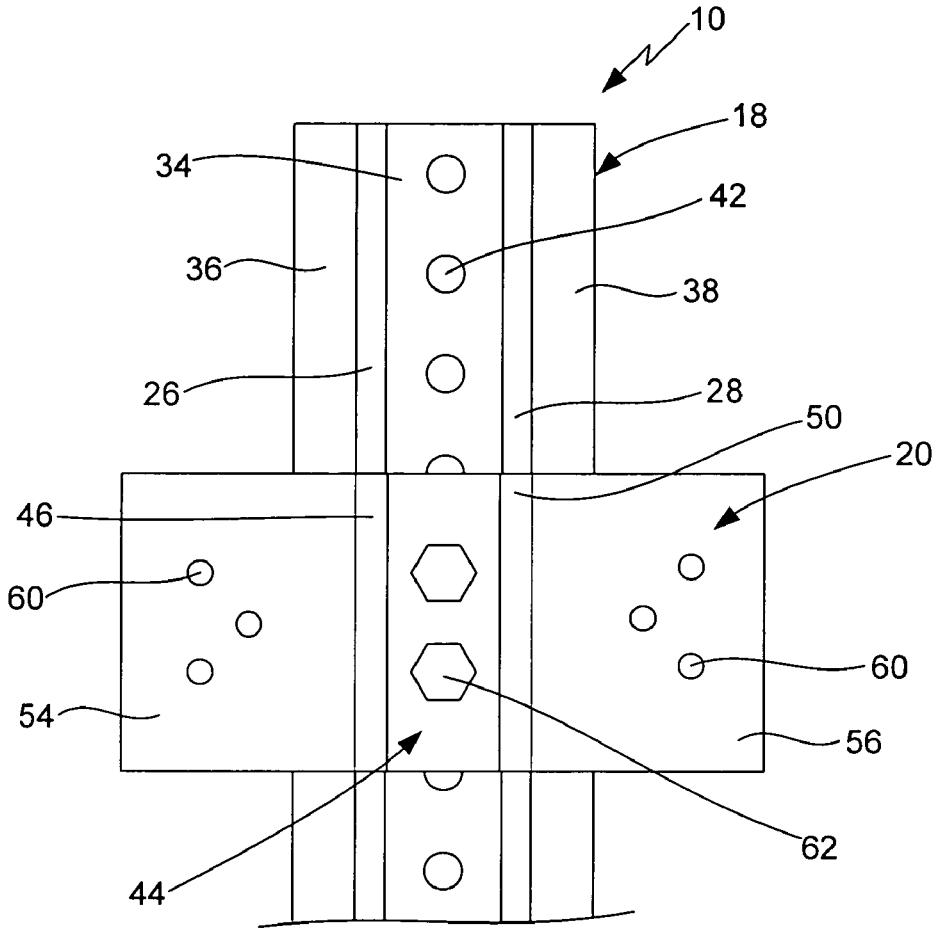
FIG. 5 is a front view of the bracket and vineyard post/signpost post that make up the metal fence post of the present invention.
Figure 6:
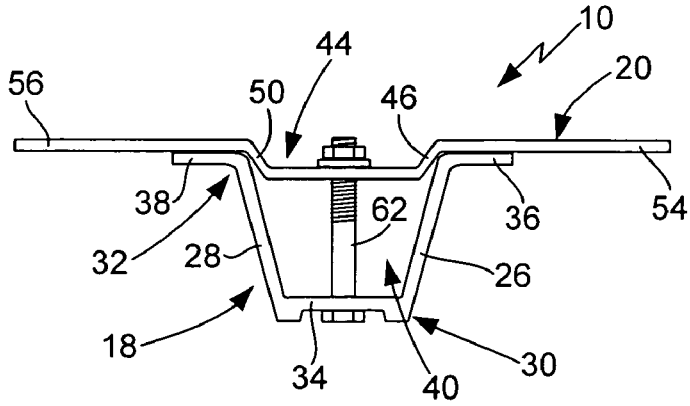
FIG. 6 is a top view of the metal fence post of FIG. 5.

The elongated post member 18 of metal fence post 10 of the present invention is preferably the commonly available vineyard post/signpost post that, as discussed above, has not heretofore been utilized in wood fence systems such as the wood fence system 12 of the present invention. Presently, these posts are primarily utilized, and have been for many years, in vineyards and to hold up road signs and the like. The elongated post member 18 (vineyard post/signpost post) is best shown in FIGS. 3 through 6. In cross-section, as shown in FIGS. 4 and 6, the elongated post member 18 has a pair of spaced apart sloping sidewalls, first sidewall 26 and second sidewall 28, each having a back edge 30 and a front edge 32. The sidewalls 26 and 28 are joined at their back edges 30 by a substantially horizontal back wall 34. A pair of outwardly extending, but relatively short, wing flanges, identified as first wing flange 36 and second wing flange 38, extend outwardly from the front edges 32 of each of the sidewalls 26 and 28 in a configuration that is generally parallel to and in spaced apart relation with the back wall 34, such that the post member has a generally U-shaped cross-section with the sidewalls 26 and 28 sloping outward from the back wall 34 to the wing flanges 36 and 38. The first wing flange 36 extends outwardly from the first sidewall 26 and the second wing flange 38 extends outwardly, but in the same plane as first wing flange, from the second sidewall 28. The first sidewall 26, second sidewall 28 and back wall 34 define a channel 40 that extends the full length of post member 18. In a preferred embodiment, channel 40 is generally in a U-shape with the sides of the "U" (the sidewalls 26 and 28) extending in an outwardly sloping direction from the ends of back wall 34 to the front edges 32 where they connect to wing flange 36 or 38, as shown in FIGS. 4 and 6.

The back wall 34 of elongated post member 18 has a plurality of mounting apertures 42 that are utilized, as set forth in more detail below, to mount the bracket 20 to post member 18, as shown in FIGS. 3 through 6, so that the rails 14 may be mounted to the bracket 20 to form fence system 12. For the commonly available vineyard post/signpost, which already has mounting apertures 42, the mounting apertures 42 are generally disposed along the entire length of elongated post member 18. If a post member 18 is specially made for the fence post 10 of the present invention, it may only be necessary to provide mounting apertures 42 in back wall 34 at those locations where the rails 14 will be attached to post member 18, as set forth in more detail below. Although the post member 18 is commonly manufactured and generally easily and economically obtained, from its use as a vineyard post/signpost, the somewhat small length of the wing flanges 36 and 38 and other considerations (i.e., aesthetics and hole sizes) have previously limited consideration of these posts as fence posts in a wood fence system. Due to the availability and common use of these post members 18, utilization of the post members 18 generally provides for a lower cost fence system 12 than those that require specially made posts. Typically, post members 18 are made out of extruded and billet steel and can be utilized with a weathered steel finish. If preferred, the post members 18 can be powder coated a desired color, such as brown to more aesthetically "fit" with the fence, or provided with a galvanized or clean/new steel finish. For increased protection against corrosion for the first end 22, which is placed in concrete, dirt or other materials, the first end 22 of post member 18 can be galvanized while the second end 24 is left with a weathered "natural" finish.

Figure 7:
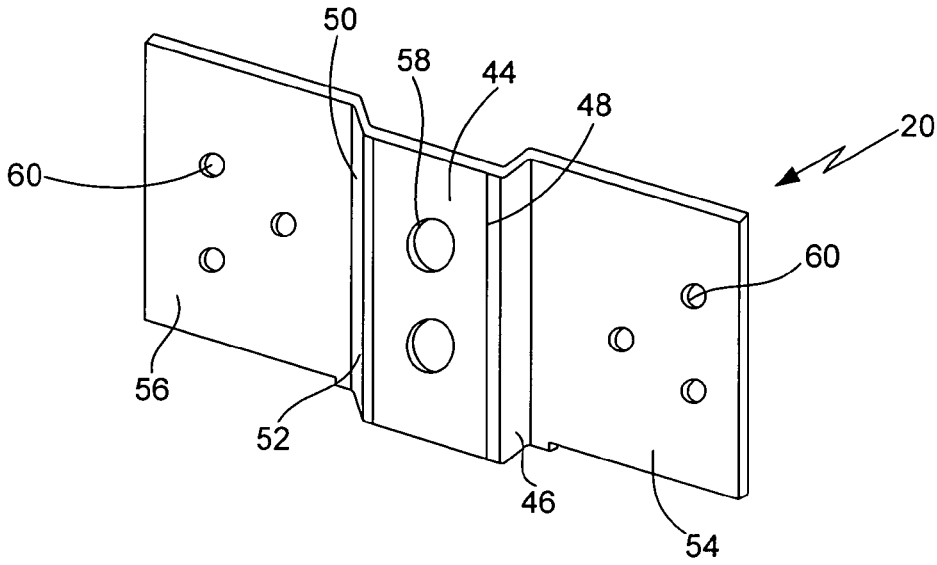
FIG. 7 is a back perspective view of a bracket configured according to a preferred embodiment to comprise a part of the metal fence post of the present invention.
Figure 8:
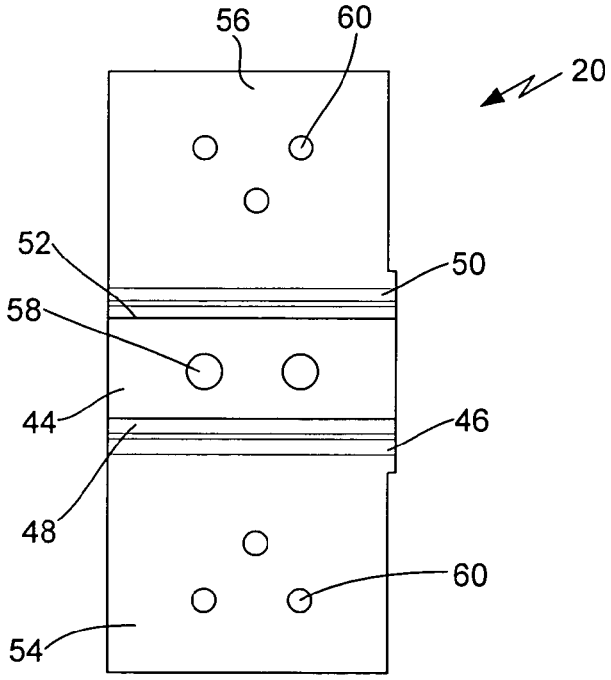
FIG. 8 is a back view of the bracket of FIG. 7.
Figure 9:
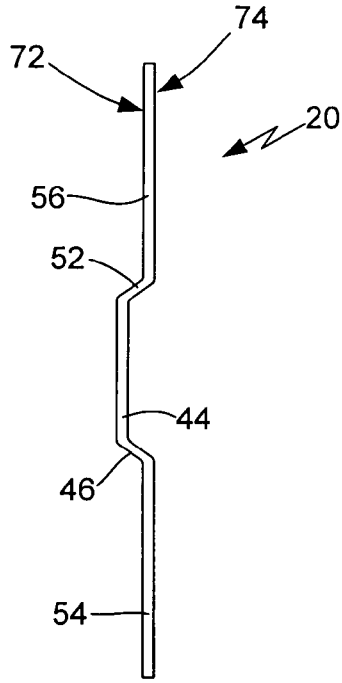
FIG. 9 is a top view of the bracket of FIG. 8.

As stated above, in the preferred embodiment of fence post 10 of the present invention, bracket member 20 attaches to elongated post member 18 in a manner that facilitates mounting one or more rails 14 to bracket member 20 in a generally horizontal position. In an alternative embodiment, bracket member 20 can be made integral with post member 18. Bracket member 20 has a center section 44, a first sidewall 46 at the first edge 48 of center section 44, a second sidewall 50 at the second edge 52 of center section, a first flange 54 that extends outwardly from first sidewall 46 and a second flange 56 that extends outwardly from second sidewall 50, as best shown in FIGS. 7 through 9. In the preferred embodiment, first flange 54 and second flange 56 are substantially in the same plane and generally parallel to, but in spaced apart relation to, center section 44. To facilitate installation of bracket 20 onto post member 18, center section 44 has one or more bracket mounting apertures 58 that are positioned so that they will be substantially aligned with mounting apertures 42 on back wall 34 of post member 18. In the embodiment shown in the figures, two bracket mounting apertures 58 are utilized. To facilitate attachment of a rail 14 to bracket 20, as explained below, each of the first 54 and second 56 flanges have one or more rail mounting apertures 60 thereon. In the embodiment shown in the figures, three rail mounting apertures 60 are utilized on each of the flanges 54 and 56.

Although bracket 20 can be manufactured out of a wide variety of different materials, the preferred material is metal for purposes of strength and durability. In one configuration, the bracket 20 can be made from a 14 gauge metal, having a nominal thickness of 0.0755 inches. Various other materials, including composites having sufficient strength and durability, and thickness of such material will also be suitable for bracket 20 of the present invention. In one embodiment, first flange 54 and second flange 56 each have a width, measured from first edge 48 or second edge 52, respectively, outward of approximately 2.25 inches, with a center section 44 width of approximately 1.75 inches, for a total width of approximately 6.25 inches. The width of center section 44 should be selected such that center section 44 will fit into the top of channel 40 between the first sidewall 26 and the second sidewall 28 of post member 18, as shown in FIGS. 4 and 6. Preferably, the first sidewall 46 and second sidewall 50 will have a depth (i.e., measured between the plane running through the first 54 and second 56 sidewalls and a plane through center section 44) of at least 0.5 inches so that center section 44 will be spaced apart a minimum of approximately 0.5 inches from the plane running through first 54 and second 56 flanges to provide a space for the rails 14 to pass over center section 44 with a 0.5 inch lock style nut in place without interference, as shown in FIG. 4. If necessary, the various above dimensions can be adjusted to accommodate different sizes of bolts or, if different connectors are utilized, for other components that will be used to secure bracket 20 to post member 18. The height of bracket 20, measured from the bottom edge to the top edge of the first flange 54, second flange 56 and center section 44, is preferably less than the height of the wood member that will be utilized for rail 14. Typically, the wood rail 14 used for fence system 12 will be a 2×4, the height of which is slightly more than 3.5 inches. A bracket height of approximately 3.5 inches will allow the 2×4 rail 14 to cover the bracket 20, thereby hiding it from view. If another size of rail 14 is to be utilized for fence system 12, it is preferred that the height of bracket 20 be selected such that it is less than the height of the rail 14 so the bracket 20 will be effectively hidden from view when it is covered by rail 14.

If, as in the preferred embodiment, post member 18 and bracket 20 are separate components, various mechanisms can be utilized to secure bracket 20 to post member 18. For instance, bracket 20 can be welded to post member 18 or a properly selected adhesive can be utilized to attach bracket 20 to post member 18. In the preferred embodiment, a connector 62 is utilized to attach bracket 20 to post member 18. In one embodiment, connector 62 can be a screw, bolt or like element that is placed through one of the mounting apertures 42 of post member 18 and then connects to an appropriate element located on the center section 44 of bracket 20 or be placed through one of the bracket mounting apertures 58 in center section 44 of bracket 20 and then connect to an appropriate element located on the back wall 34 of post member 18. However, in the preferred embodiment, as shown in FIGS. 3 through 6, connector 62 is a bolt/nut combination that is configured to pass through one of the mounting apertures 42 and one of the bracket mounting apertures 58. As shown in FIGS. 4 and 6, with the apertures 42 and 58 aligned, the bolt/nut connector 62 passes through both apertures 42 and 58 to securely attach bracket 20 to post member 18. With the width of center section 44 being less than the width of channel 40 at the first 36 and 38 wing flanges, the bolt/nut connector 62 will pull center section 44 into channel 40. With center section 44 received in channel 40 of the post member 18, the first flange 54 of bracket 20 will be in substantially abutting relation with the first wing flange 36 of post member 18 and the second flange 56 of bracket 20 will be in substantially abutting relation with the second wing flange 38 of post member 18, as shown in FIGS. 4 and 6, to effectively lock the bracket 20 onto post member 18. With the two components secured together, the rails 14 can be attached to the bracket, as described below, to provide a horizontal support for the vertically disposed pickets 16. To further facilitate the clamping effect between the bracket 20 and post member 18, it is preferred that the first 46 and second 50 sidewalls of bracket 20 have an outward slope from center section 44 to flanges 54 and 56 that substantially corresponds to the sloping sidewalls 26 and 28 of post member 18, which slope outwards from back wall 34 to first 36 and second 38 wing flanges. In this manner, when bolt/nut connector 62 is tightened it will pull central section 44 of bracket 20 into channel 40 of post member 18 and effectively lock it into position with the sidewalls 46/48 of bracket 20 tightly abutting sidewalls 26/28 of post member 18, thereby holding bracket 20 in place and preventing any vertical or lateral movement of bracket 20 relative to post member 18.

Figure 10:
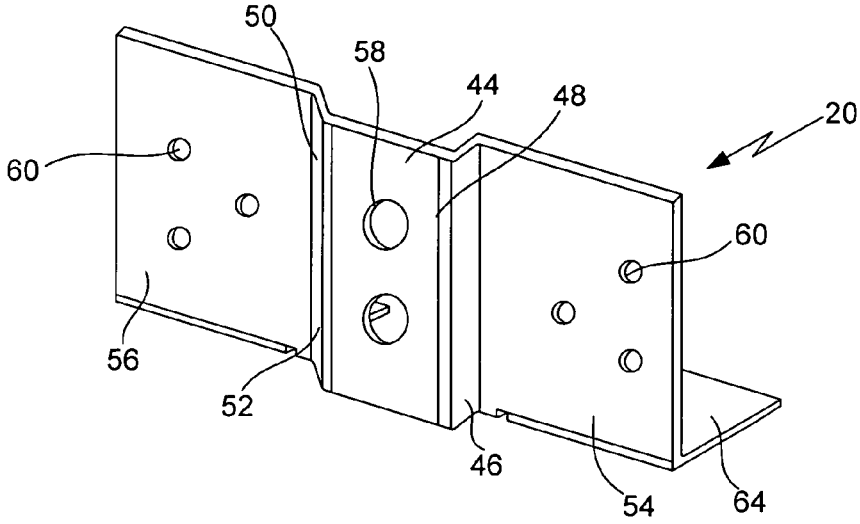
FIG. 10 is a back perspective view of an alternative configuration for the bracket that comprises part of the metal fence post of the present invention showing use of a pair of support plates attached thereto.
Figure 11:
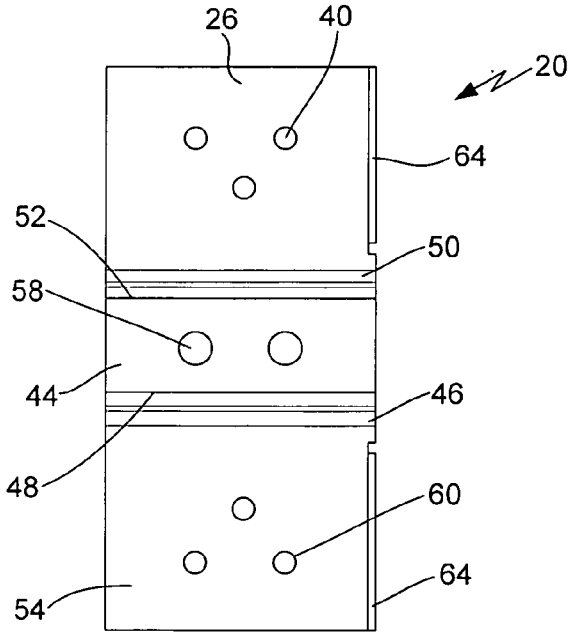
FIG. 11 is a back view of the bracket of FIG. 10.

An alternative embodiment of bracket 20, which may be preferred in many circumstances, is shown in FIGS. 10 through 14. In this embodiment, bracket 20 has a support plate 64 that extends perpendicularly outward from the bottom edge of each of first flange 54 and second flange 56. As best shown in FIG. 10, the positioning of support plate 64 forms a generally L-shape bracket that can be utilized to support wooden rail 14 while it is being attached to the first 54 and second 56 flanges of bracket 20, thereby eliminating the need to have a second person hold rail 14 while it is attached. As well known to those skilled in the art of installing fence systems, the installation of the rails 14 to the prior art post generally requires at least two persons, one at or near each end of the rail 14 to hold the rail 14 up in a generally horizontal position and against the prior art post while the ends are attached thereto. With the modified bracket 20, having support plates 64, attached to post member 20 to form fence post 10, a single person can rest one end of a rail 14 on the support plate 64 of two adjacent fence posts 10 and then attach one end of the rail 14 at a time to its respective fence post 10. Use of support plates 64 on each of flanges 54 and 56 has the potential to significantly reduce the amount of time, and therefore cost, of attaching the rails 14 to the metal fence posts 10, thereby reducing the overall cost of fence system 12. Because support plates 64 are only intended to support a rail 14 during its installation, once both ends of rail 14 are securely attached to their respective fence posts 10, the support plates 64 are not intended to provide support to rail 14. In one embodiment, the support plates 64 are the full length of their respective flange 54 or 56 and extend outwardly therefrom approximately 1.0 inches. Other configurations can also be utilized.

Figure 15:
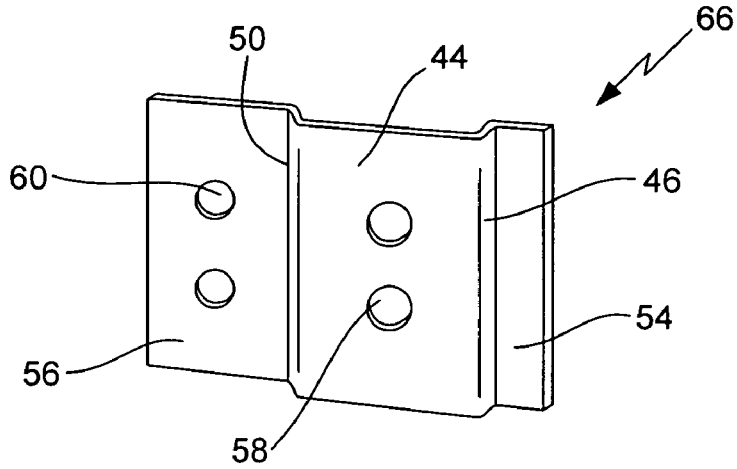
FIG. 15 is a back perspective view of an end bracket configured according to a preferred embodiment of the present invention.
Figure 16:
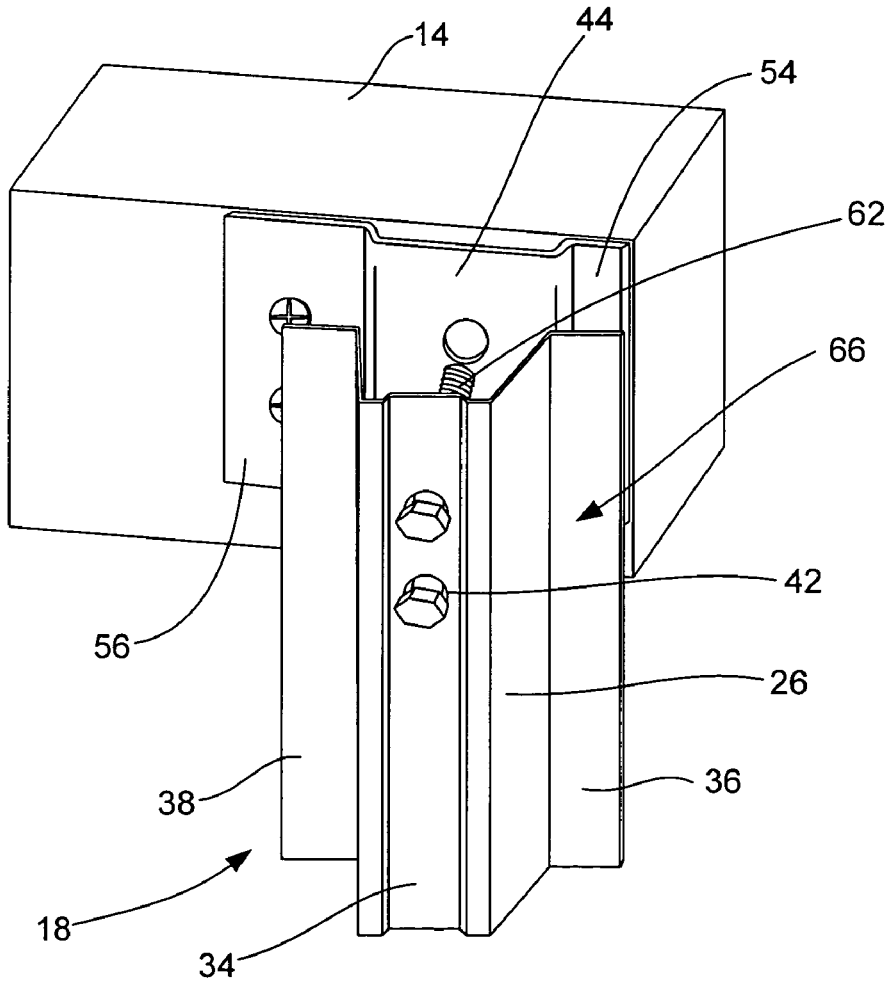
FIG. 16 is a top perspective view of the end bracket of FIG. 15 as part of the fence system of the present invention.
Figure 17:
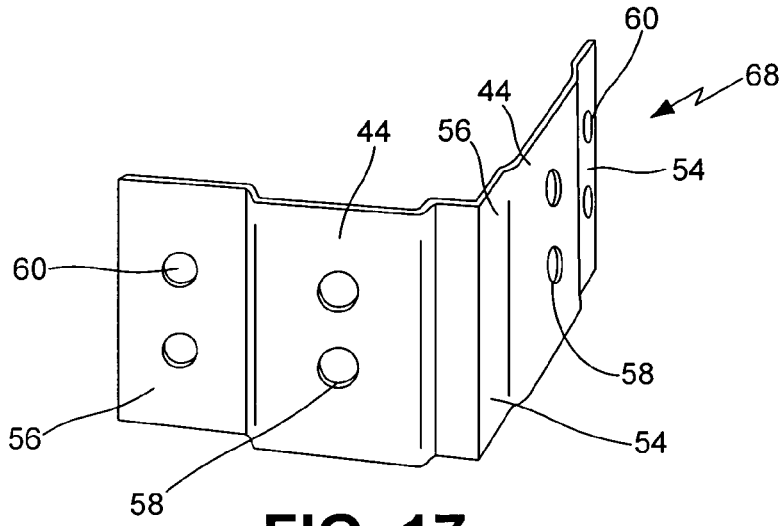
FIG. 17 is a top perspective view of a corner bracket configured according to a preferred embodiment of the present invention.
Figure 18:
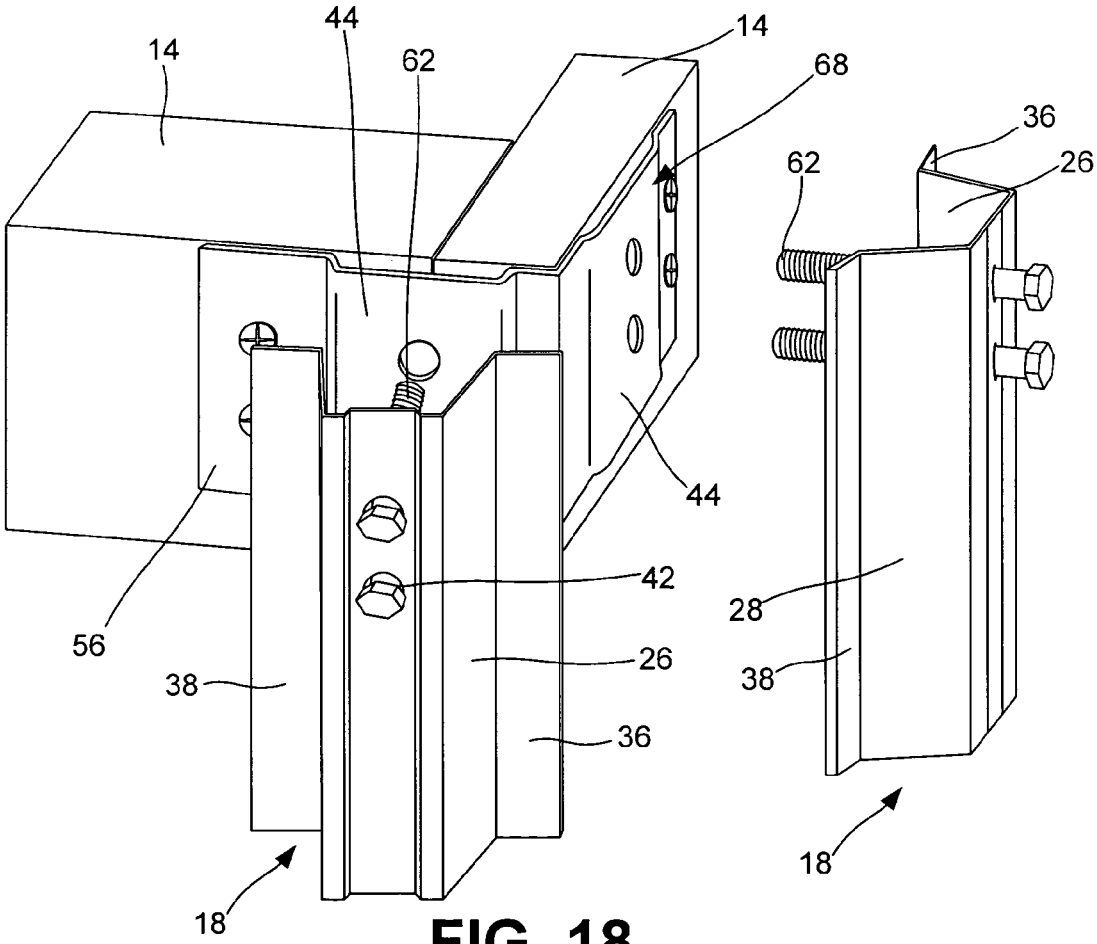
FIG. 18 is a top perspective view of the corner bracket of FIG. 17 as part of the fence system of the present invention.

FIGS. 15 through 18 show alternative configurations for the bracket 20 that is utilized with post member 18 to define fence post 10. In FIGS. 15 and 16, bracket 20 is configured as an end bracket 66. As with the bracket 20 described above, end bracket 66 has a center section 44 with a first flange 54 on one side of center section 44 and a second flange 56 on the other side. In this embodiment, however, first flange 54 is substantially shortened so that its width, measured from center section 44, is approximately equal to the first wing flange 36 of the post member 18 (typically 0.5 inches or so). In use, as best shown in FIG. 16, the bolt/nut connector 62 is inserted through a mounting aperture 42 on post member 18, inserted through a bracket mounting aperture 58 in end bracket 66 and then end bracket 66 is attached to rail 14. The user tightens the nut onto the bolt to secure post member 18 to end bracket 66. FIGS. 17 and 18 illustrate a similarly configured corner bracket 68, which is substantially comprised of a pair of opposite directed end brackets 66. Corner bracket 68 is installed on a pair of rails 14 in the manner as end bracket 66 described above, except that a post member 18 is secured to each half of corner bracket 68, as shown in FIG. 18.

The fence system 12 of the present invention utilizes metal fence post 10, comprised of the elongated post member 18 inserted into the ground and standing upright relative thereto and bracket 20 securely attached to the post member 18, rails 14 attached to each bracket 20 in a generally horizontal position and a plurality of pickets 16 vertically attached to each rail 14. Preferably, the ends of adjoining rails 14 will be abutting at or near the center of bracket 20, as shown in FIGS. 2 and 3, such that the adjoining rails 14 will appear to be a single solid rail 14. The elongated post member 18 and bracket 20 are configured as described above. Preferably, to lower the overall cost of fence system 12, post member 18 is the vineyard post/signpost post that is commonly available. Bracket 20 is preferably attached to post member 18 with one or more connectors 62, such as a bolt/nut connector, that is configured to pull the center section 44 of bracket 20 into the channel 40 formed by the back wall 34 and sidewalls 26 and 28 of post member 18 to tightly engage bracket 20 with post member 18 to effectively form a single unit.

Figure 12:
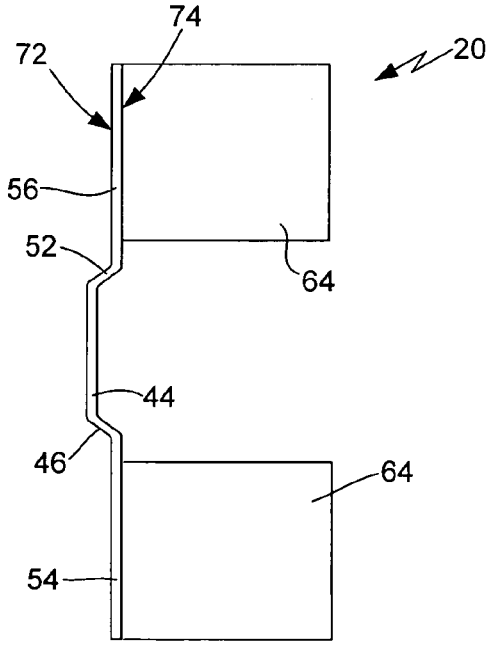
FIG. 12 is a top view of the bracket of FIG. 11.
Figure 13:
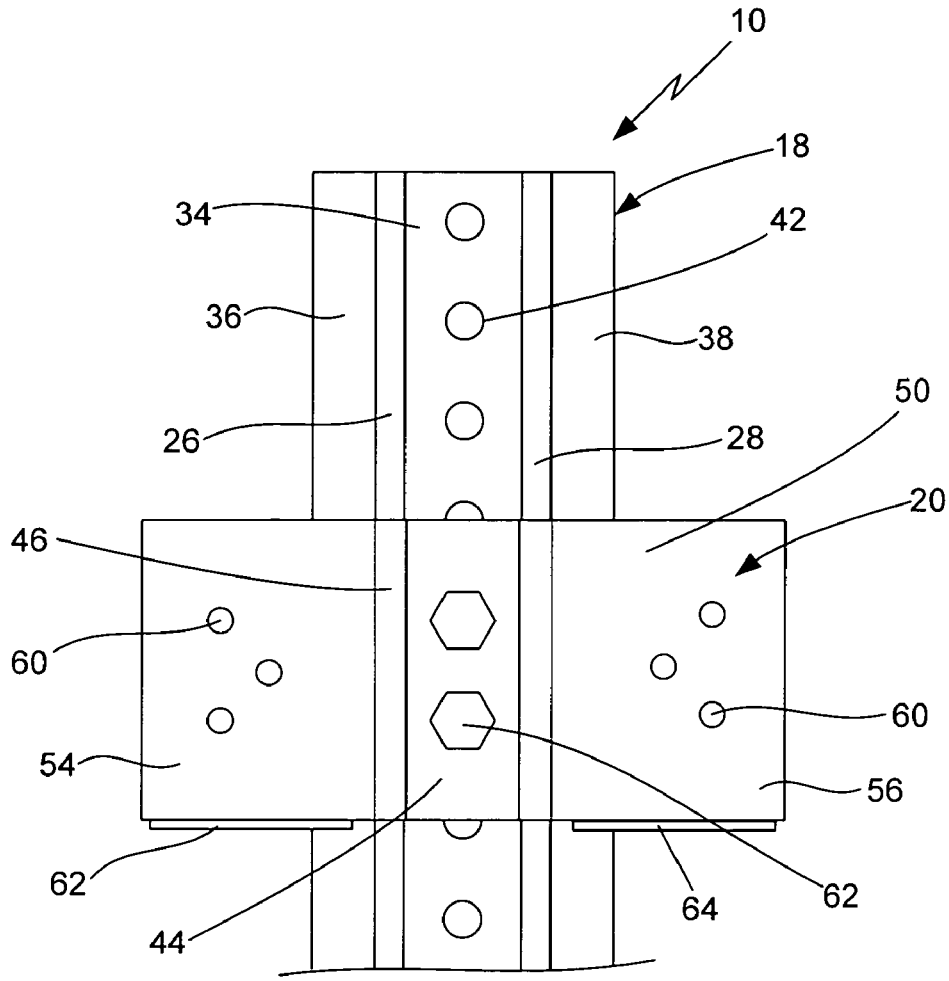
FIG. 13 is a front view of the bracket of FIG. 10 attached to a commonly available vineyard post/signpost to comprise the metal fence post of the present invention.
Figure 14:
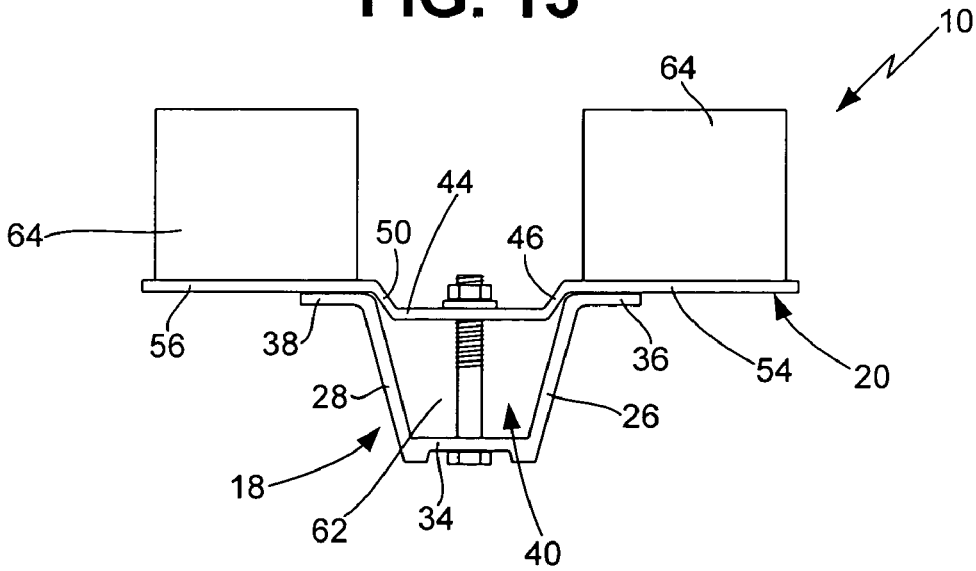
FIG. 14 is a top view of the metal fence post of FIG. 13.

The method of constructing a fence of the present invention starts with inserting a firs/lower end 22 of the elongated post member 18 into the ground, securing it in place with concrete, dirt or other material, attaching the bracket 20 to post member 18 at the desired height by inserting a connector 62 through one of the mounting apertures 42 of post member 18 and one of the bracket mounting apertures 58 on bracket 20 and tightening it to drawing the center section 44 of the bracket 20 into the channel 40 formed by the back wall 34 and sidewalls 26/28 of post member 18. If the bracket 20 has support plate 64, the user rests the ends of rail 14 on the support plate 64 of adjacent fence posts 10 and then attaches rail 14 to one of first flange 54 or second flange 56 of bracket by inserting a screw 70 or the like, best shown on FIG. 4, into rail 14 from the front side 72 of bracket 20 to secure the rail 14 to the back side 74 of bracket 20. As shown in FIGS. 9 and 12, the front side 72 of bracket 20 is that side that faces front (i.e., FIG. 1) of the fence system 12 and the rear side 74 of bracket 20 is that side that faces rearward (i.e., FIG. 2) of the fence system 12. If the bracket 20 does not have support plate 64, the user will have to request the assistance of a second person to hold the one end of rail 14 while it is attached to fence post 10. The rails 14 are positioned to cover up the flanges 54/56 of bracket 20, with the height of flanges 54/56 being less than the height of the rails 14. Once the rails 14 are attached, a plurality of pickets 16 are attached to the rails 14, preferably in a substantially side-by-side configuration (as shown in FIGS. 1 and 2) using screws 70 or nails that pass from the front side of the pickets 16 into the rails 14 on their rear side. The use of bracket 20 attached to commonly available post members 18, as described above, provides both economic and aesthetic benefits. These components allow the fence to be constructed in such a manner that the metal fence post 10 is intended to be a visible design component of the fence, instead of requiring additional time and cost to hide the fence post, as is the configuration of certain prior art fence posts.

Figure 19:
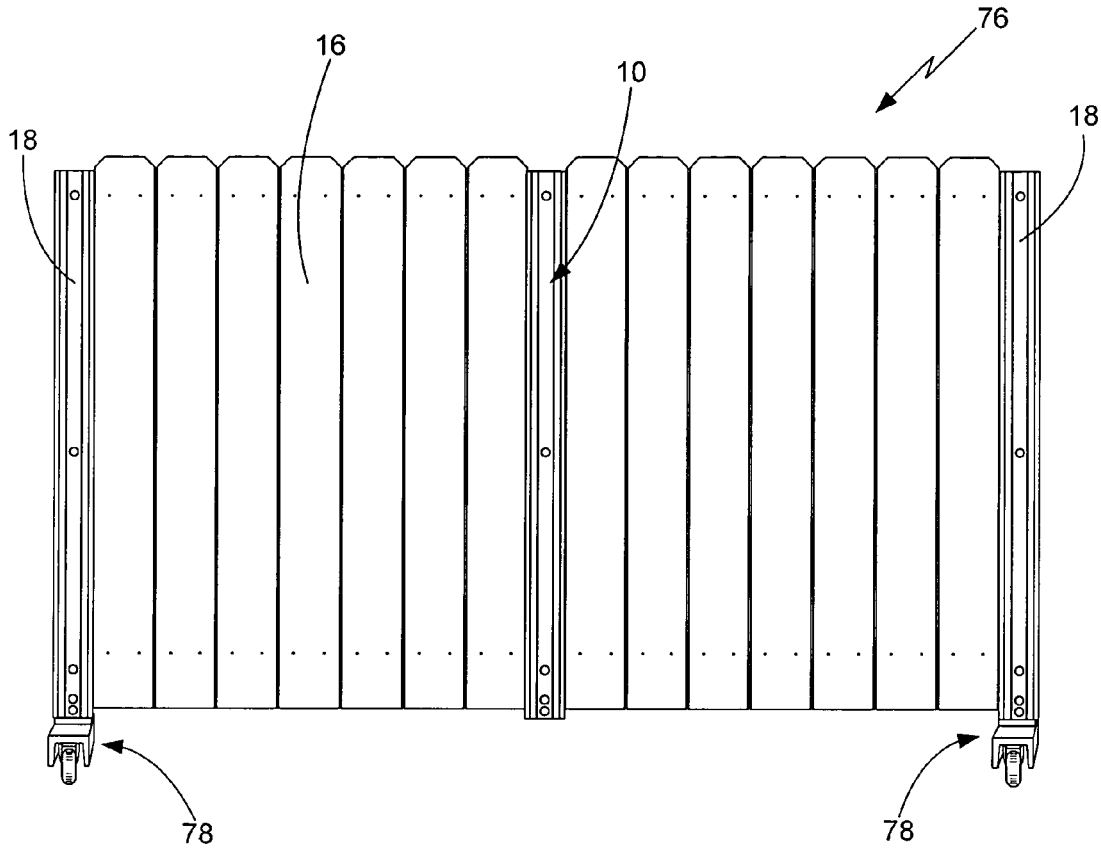
FIG. 19 is a front view of a preferred embodiment of a portable fence system utilizing the metal fence post and fence system of the present invention.
Figure 20:
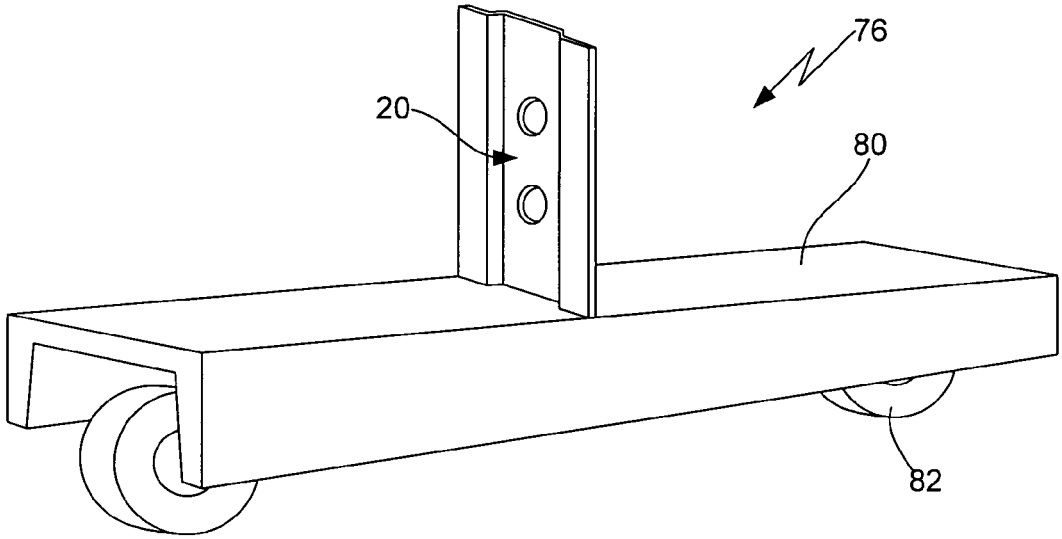
FIG. 20 is a perspective view of a preferred embodiment of the truck unit for the portable fence system of FIG. 19.

An alternative use for fence post 10 is shown in FIGS. 19 and 20. These figures illustrate the use of the fence post 10 of the present invention for a portable fence 76. There exists a need for a fence that is configured to be moved around at the user's convenience. For instance, many municipalities require the homeowner to place his or her trash containers behind a wall, fence or other blocking device so that the containers are not visible from the street. Due to the need to have the containers readily accessible for trash or other disposal and the lack of room along the side of many houses, for many people the cost and effort of placing a blocking device is somewhat prohibitive. With a portable fence, the user could hide the containers and then move the fence out of the way to get to the containers as needed (i.e., to dispose of trash or move the containers to the street for collection). The portable fence 76 of the present invention comprises at least a pair of fence posts 10, one or more rails 14 (not shown, but similar to FIG. 2) attached to and interconnecting the fence posts 10 and a plurality of pickets 16 attached to the rails 14, as generally described above for fence system 12, as shown in FIG. 19. To make the portable fence 76 portable, at least a pair of specially configured truck mechanisms 78 are utilized. As best shown in FIG. 20, truck mechanism 78 comprises a base frame member 80, one or more wheels 82 attached to frame member 80 and a modified bracket 20 attached to the top of the base frame member 80. In a preferred embodiment, base frame member 80 is a standard steel channel and a pair of swivel rollers are utilized for wheels 82. The bracket 20 is modified to have shortened length flanges 54/56, similar to the short side of the end bracket 66 or corner bracket 68. The flanges 54/56 are shortened to be approximately the length of the first 36 and second 38 wing flanges of post member 18. Instead of being inserted into the ground, the first/lower end 22 of the post member 18 is attached to the modified bracket 20 using the bolt/nut connector 62 as described above or a like connector.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape, and use. For instance, there are numerous components described herein that can be replaced with equivalent functioning components to accomplish the objectives of the present invention.

What is claimed is:

1. A fence post for a fence system having one or more rails supporting a plurality of pickets mounted to the rails, said fence post comprising:

an elongated post member having a first end configured to be inserted into the ground and a second end configured to support the rails and the pickets, said post member having a first sidewall, a second sidewall spaced apart from said first sidewall, a back wall interconnecting a back edge of each of said first sidewall and said second sidewall, a first wing flange extending outwardly from a forward edge of said first sidewall and a second wing flange extending outwardly from a forward edge of said second sidewall, said first wing flange and said second wing flange substantially in the same plane in spaced apart relation to said back wall, said first sidewall, said second sidewall and said back wall defining a channel, said back wall having one or more mounting apertures, each of said mounting apertures configured to receive a connector therein; and a bracket attached to said post member and configured to attach to at least one of said one or more rails, said bracket comprising a center section, a first sidewall attached to a first edge of said center section, a second sidewall attached to a second edge of said center section, a first flange extending outwardly from said first sidewall and a second flange extending outwardly from said second sidewall, said first flange and said second flange substantially in the same plane in spaced apart relation to said center section, said center section received in said channel of said post member with said first flange in substantially abutting relation with said first wing flange and said second flange in substantially abutting relation with said second wing flange, said center section of said bracket having at least one bracket mounting aperture cooperatively configured with said mounting apertures of said post member to receive said connector therein so as to securely mount said bracket to said post member.

2. The fence post according to claim 1, wherein the height of said bracket is less than the height of said rail.

3. The fence post according to claim 1, wherein said first sidewall of said post member angles generally outwardly from said back wall to the forward edge of said first sidewall and said second sidewall of said post member slopes generally outwardly from said back wall to the forward edge of said second sidewall and said first sidewall and said second sidewall of said bracket are in substantially corresponding relation to said first sidewall and said second sidewall, respectively, of said post member so as to facilitate reception of said center section into said channel.

4. The fence post according to claim 1 further comprising a support plate extending outwardly from each of said first flange and said second flange of said bracket, said support plate configured to support an end of said rail thereon to facilitate attachment of said rail to said bracket.

5. The fence post according to claim 1, wherein each of said first flange and said second flange of said bracket has one or more rail mounting apertures thereon, each of said rail mounting apertures configured to facilitate attachment of said rail to said bracket.

6. A fence system, comprising:

a fence post comprising an elongated post member and a bracket attached to said post member, said post member having a first sidewall, a second sidewall spaced apart from said first sidewall, a back wall interconnecting a back edge of each of said first sidewall and said second sidewall, a first wing flange extending outwardly from a forward edge of said first sidewall and a second wing flange extending outwardly from a forward edge of said second sidewall, said first wing flange and said second wing flange substantially in the same plane in spaced apart relation to said back wall, said first sidewall, said second sidewall and said back wall defining a channel, said bracket having a center section, a first sidewall attached to a first edge of said center section, a second sidewall attached to a second edge of said center section, a first flange extending outwardly from said first sidewall and a second flange extending outwardly from said second sidewall, said first flange and said second flange substantially in the same plane in spaced apart relation to said center section, said center section received in said channel of said post member with said first flange in substantially abutting relation with said first wing flange and said second flange in substantially abutting relation with said second wing flange;

a rail attached to a back side of said bracket; and a plurality of pickets attached to said rail in generally side-by-side relation along at least one of a front side or rear side of said bracket;

wherein a first end of said post member is inserted into a supporting surface, a second end of said post member supports said rails and said pickets and said back wall and at least a portion of each of said first sidewall and said second sidewall of said post member are configured to be exposed so as to enhance the aesthetics of said fence system.

7. The fence system according to claim 6, wherein said back wall of said elongated body member has one or more mounting apertures and said center section of said bracket has at least one bracket mounting aperture, said bracket mounting aperture cooperatively configured with said mounting apertures of said post member to receive a connector therein so as to securely mount said bracket to said post member.

8. The fence system according to claim 6, wherein the height of said bracket is less than the height of said rail.

9. The fence system according to claim 6, wherein said first sidewall and said second sidewall of said post member and said first sidewall and said second sidewall of said bracket are angled in substantially corresponding relation so as to facilitate engagement of said center section with said channel.

10. The fence system according to claim 6 further comprising a support plate extending outwardly from each of said first flange and said second flange of said bracket, said support plate configured to support an end of said rail thereon to facilitate attachment of said rail to said bracket.

11. The fence system according to claim 6, wherein each of said first flange and said second flange of said bracket has one or more rail mounting apertures thereon, each of said rail mounting apertures configured to facilitate attachment of said rail to said bracket.

12. A fence post for a fence system having one or more rails supporting a plurality of pickets mounted to the rails, said fence post comprising:

an elongated post member having a first end configured to be inserted into the ground and a second end configured to support the rails and the pickets, said post member having a first sidewall, a second sidewall spaced apart from said first sidewall, a back wall interconnecting a back edge of each of said first sidewall and said second sidewall, a first wing flange extending outwardly from a forward edge of said first sidewall and a second wing flange extending outwardly from a forward edge of said second sidewall, said first wing flange and said second wing flange substantially in the same plane in spaced apart relation to said back wall, said first sidewall, said second sidewall and said back wall defining a channel;

a bracket attached to said post member and configured to attach to at least one of said one or more rails, said bracket comprising a center section, a first sidewall attached to a first edge of said center section, a second sidewall attached to a second edge of said center section, a first flange extending outwardly from said first sidewall and a second flange extending outwardly from said second sidewall, said first flange and said second flange substantially in the same plane in spaced apart relation to said center section, said center section received in said channel of said post member with said first flange in substantially abutting relation with said first wing flange and said second flange in substantially abutting relation with said second wing flange; and a support plate extending outwardly from each of said first flange and said second flange of said bracket, said support plate configured to support an end of said rail thereon to facilitate attachment of said rail to said bracket.

13. The fence post according to claim 12, wherein said back wall of said elongated body member has one or more mounting apertures, each of said mounting apertures configured to receive a connector therein to mount said bracket on said post member.

14. The fence post according to claim 13, wherein said center section of said bracket has at least one bracket mounting aperture, said bracket mounting aperture cooperatively configured with said mounting apertures of said post member to receive said connector therein so as to securely mount said bracket to said post member.

15. The fence post according to claim 12, wherein the height of said bracket is less than the height of said rail.

16. The fence post according to claim 12, wherein said first sidewall of said post member angles generally outwardly from said back wall to the forward edge of said first sidewall and said second sidewall of said post member slopes generally outwardly from said back wall to the forward edge of said second sidewall and said first sidewall and said second sidewall of said bracket are in substantially corresponding relation to said first sidewall and said second sidewall, respectively, of said post member so as to facilitate reception of said center section into said channel.

17. The fence post according to claim 12, wherein each of said first flange and said second flange of said bracket has one or more rail mounting apertures thereon, each of said rail mounting apertures configured to facilitate attachment of said rail to said bracket.

* * * * *